US010519523B2

(12) United States Patent
Wada

(10) Patent No.: US 10,519,523 B2
(45) Date of Patent: Dec. 31, 2019

(54) INFRARED HEATING METHOD, INFRARED HEATING AND FORMING METHOD OF STEEL SHEET AND AUTOMOBILE COMPONENT OBTAINED THEREBY, AND INFRARED HEATING FURNACE

(71) Applicant: AISIN TAKAOKA CO., LTD., Toyota-shi, Aichi (JP)

(72) Inventor: Ryozo Wada, Toyota (JP)

(73) Assignee: AISIN TAKAOKA CO., LTD., Toyota-Shi, Aichi (JP)

( * ) Notice: Subject to any disclaimer, the term of this patent is extended or adjusted under 35 U.S.C. 154(b) by 1003 days.

(21) Appl. No.: 14/765,531

(22) PCT Filed: Jan. 30, 2014

(86) PCT No.: PCT/IB2014/058654

§ 371 (c)(1),
(2) Date: Aug. 3, 2015

(87) PCT Pub. No.: WO2014/118723

PCT Pub. Date: Aug. 7, 2014

(65) Prior Publication Data

US 2015/0376728 A1 Dec. 31, 2015

(30) Foreign Application Priority Data

Feb. 1, 2013 (JP) ..... 2013-018877

(51) Int. Cl.
*C21D 1/34* (2006.01)
*C21D 9/46* (2006.01)
(Continued)

(52) U.S. Cl.
CPC ..... *C21D 1/34* (2013.01); *C21D 1/18* (2013.01); *C21D 8/0247* (2013.01); *C21D 9/46* (2013.01); *F27D 11/12* (2013.01)

(58) Field of Classification Search
CPC ..... C21D 2221/00; C21D 1/34; C21D 9/46
(Continued)

(56) References Cited

U.S. PATENT DOCUMENTS 4,229,236 A 10/1980 Heath
6,742,374 B2 6/2004 Ozawa
(Continued)

FOREIGN PATENT DOCUMENTS

CN 102284638 A 12/2011
CN 103173606 A 6/2013
(Continued)

OTHER PUBLICATIONS

International Search Report (PCT/ISA/210) dated Aug. 20, 2014, by the European Patent Office as the International Searching Authority for International Application No. PCT/IB2014/058654.
(Continued)

*Primary Examiner* — Weiping Zhu
(74) *Attorney, Agent, or Firm* — Buchanan Ingersoll & Rooney PC

(57) ABSTRACT

An infrared heating method comprises: wholly infrared heating a steel sheet uniformly up to a temperature which is A3 point or above; and temperature distribution controlling, wherein, after the wholly infrared heating, partial lowering of a light intensity of infrared rays irradiated toward the steel sheet is performed to provide a first region having a temperature of A3 point or above and a second region having a temperature less than A1 point in the steel sheet.

10 Claims, 9 Drawing Sheets

(51) Int. Cl.
*C21D 1/18* (2006.01)
*F27D 11/12* (2006.01)
*C21D 8/02* (2006.01)

(58) Field of Classification Search
USPC ..... 148/565
See application file for complete search history.

(56) References Cited

U.S. PATENT DOCUMENTS

| | | | | |
|---|---|---|---|---|
| 8,847,126 | B2 | 9/2014 | Ishiguro et al. | |
| 2002/0113041 | A1 | 8/2002 | Ozawa | |
| 2004/0060623 | A1 | 4/2004 | Boke et al. | |
| 2009/0320968 | A1* | 12/2009 | Boeke | C21D 1/185 148/546 |
| 2010/0300584 | A1 | 12/2010 | Buschsieweke et al. | |
| 2011/0132897 | A1 | 6/2011 | Ishiguro et al. | |
| 2011/0303330 | A1 | 12/2011 | Ichikawa | |
| 2012/0135263 | A1 | 5/2012 | Kobayashi et al. | |
| 2013/0160906 | A1 | 6/2013 | Bake et al. | |
| 2014/0083572 | A1 | 3/2014 | Schwartz | |

FOREIGN PATENT DOCUMENTS

| | | | | | |
|---|---|---|---|---|---|
| EP | 2 322 672 | A1 | | 5/2011 | |
| JP | 08-139047 | A | | 5/1996 | |
| JP | 2002-241835 | A | | 8/2002 | |
| JP | 2005-161366 | A | | 6/2005 | |
| JP | 2009-022995 | A | | 2/2009 | |
| JP | 4575976 | B2 | | 11/2010 | |
| JP | 2011-099567 | A | | 5/2011 | |
| JP | 2011099567 | A | * | 5/2011 | H04W 76/12 |
| JP | 2011-136342 | A | | 7/2011 | |
| JP | 2011-255413 | A | | 12/2011 | |
| WO | 2010089103 | A1 | | 8/2010 | |
| WO | WO 2012/120123 | A | | 9/2012 | |

OTHER PUBLICATIONS

Written Opinion (PCT/ISA/237) dated Aug. 20, 2014, by the European Patent Office as the International Searching Authority for International Application No. PCT/IB2014/058654.

Japanese Office Action, Notice of Grounds for Rejection, dated Sep. 16, 2014, by the Japanese Patent Office, for JP Application No. 2013-018877, and English translation of Office Action (5 pgs).

Maikranz-Valentine M. et al., "Components with Optimised Properties due to Advanced Thermo-mechanical Process Strategies in Hot Sheet Metal Forming", Steel Research Int., 2008 (month unknown), pp. 92-97, vol. 79, No. 2.

Office Action (First) dated Jun. 2, 2016, by the State Intellectual Property Office of the Peoples Republic of China in corresponding Chinese Patent Application No. 2016053001633150, and an English translation of the Office Action. (20 pgs).

* cited by examiner

[Fig. 1]
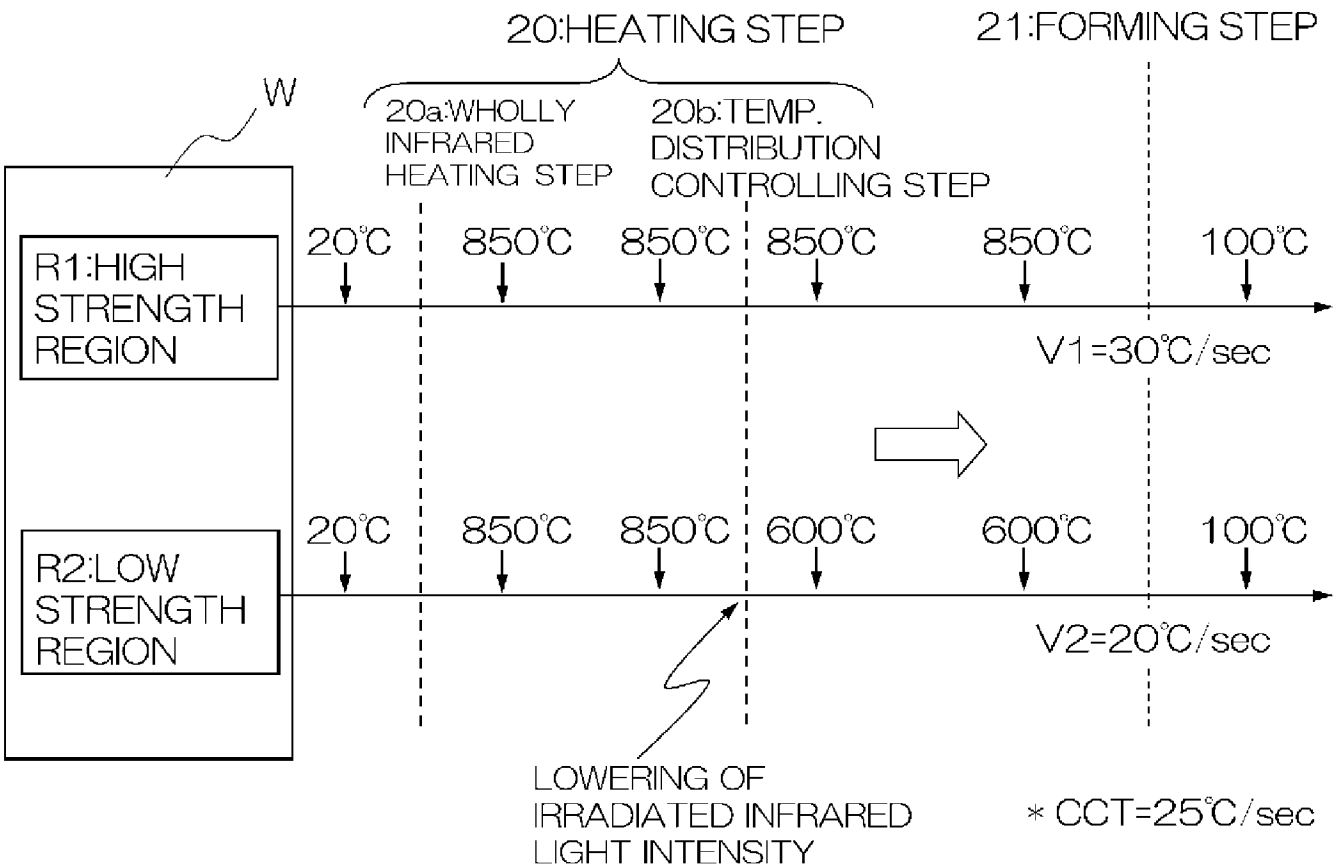

[Fig. 2]
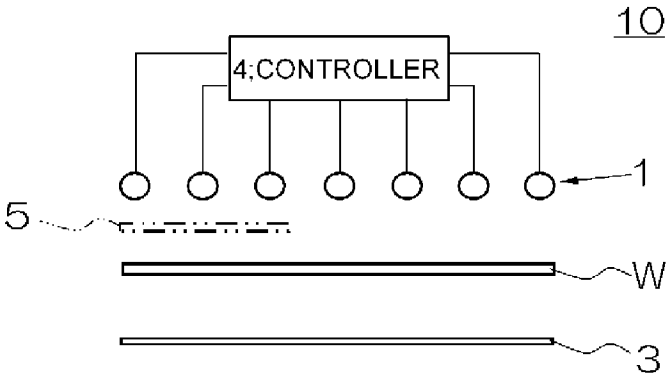

[Fig. 3]
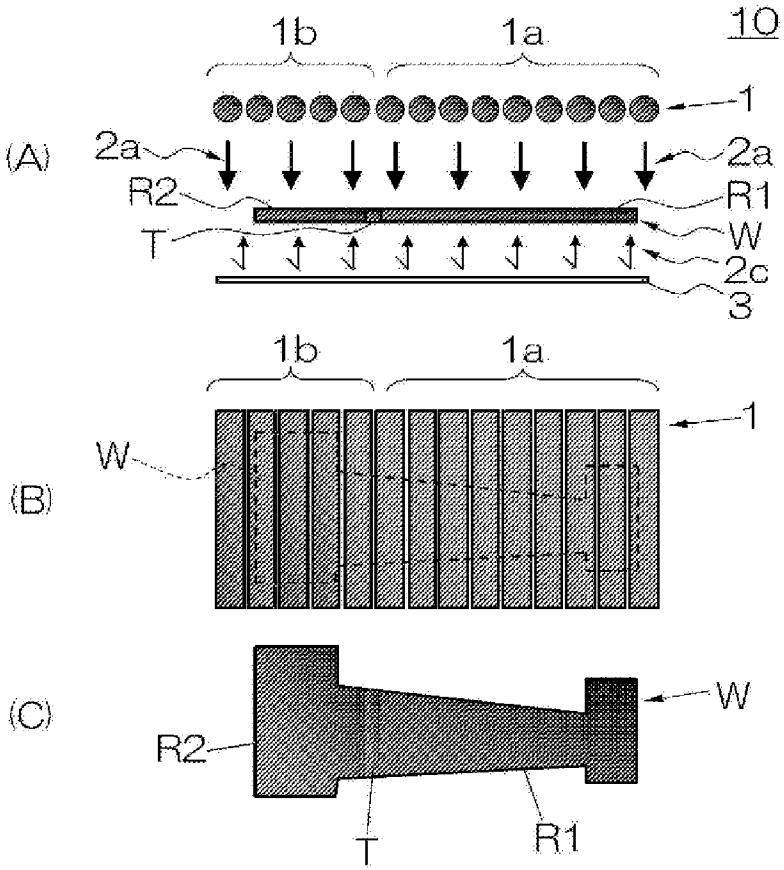

[Fig. 4]
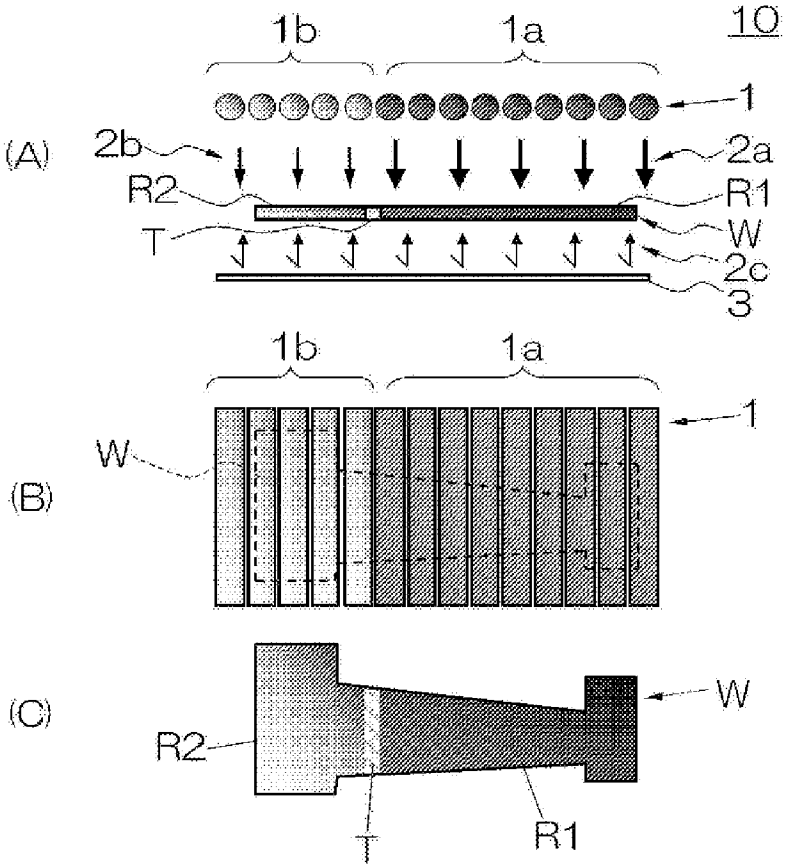

[Fig. 5]
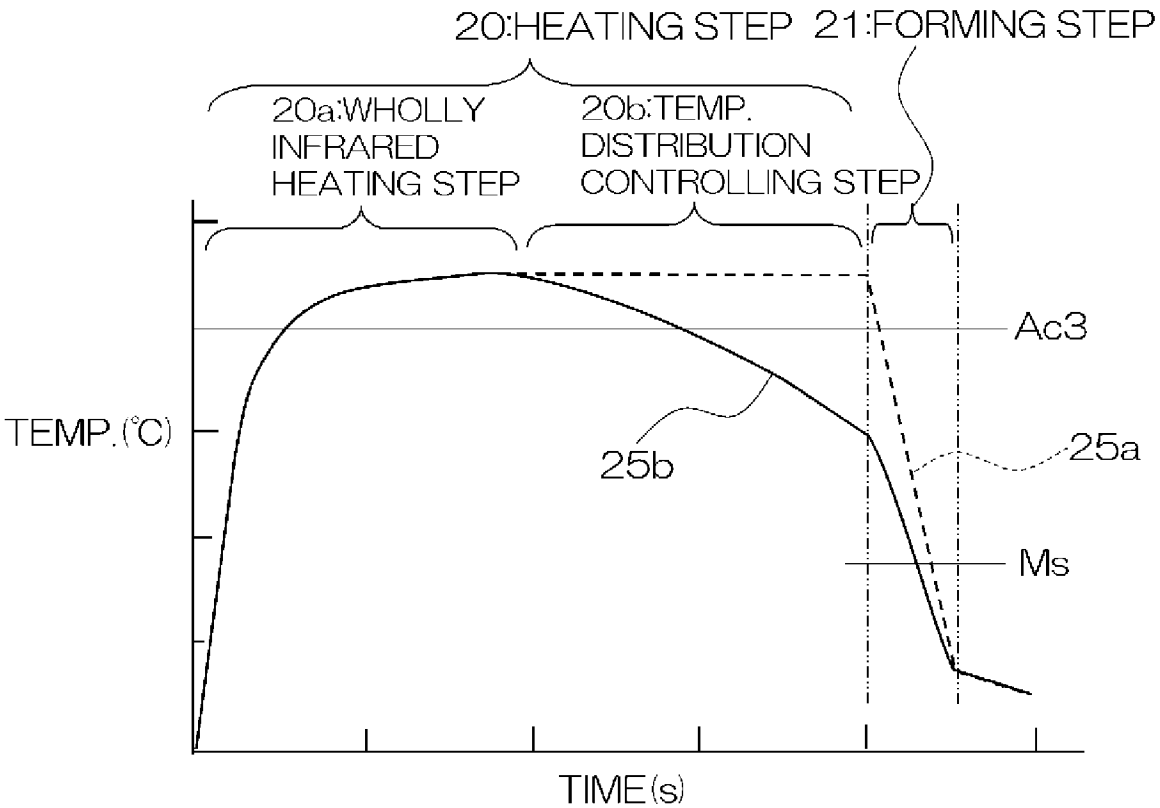

[Fig. 6]
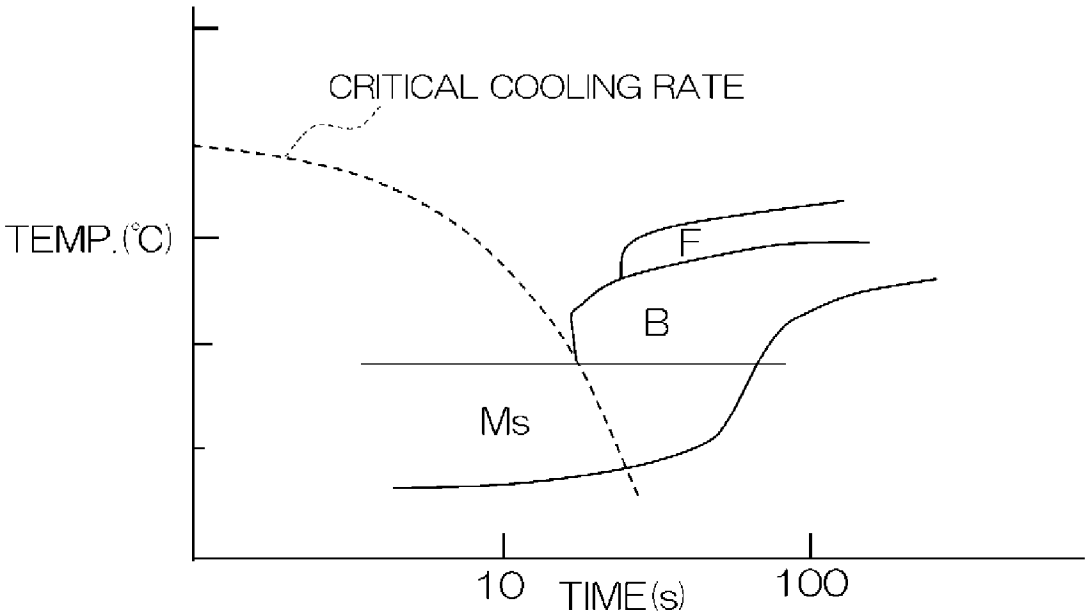

[Fig. 7]
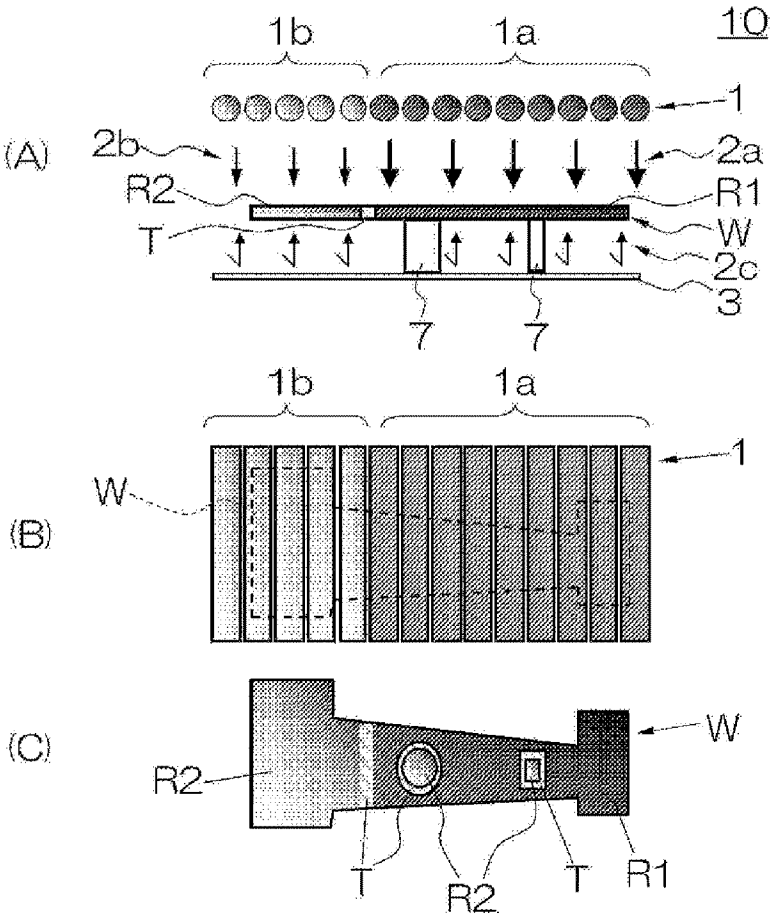

[Fig. 8]
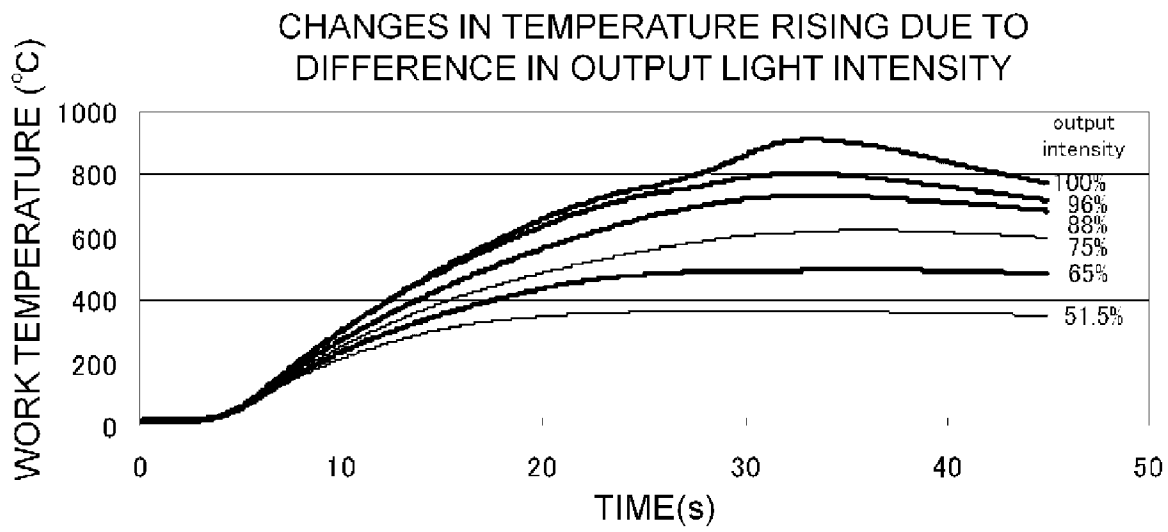

[Fig. 9]
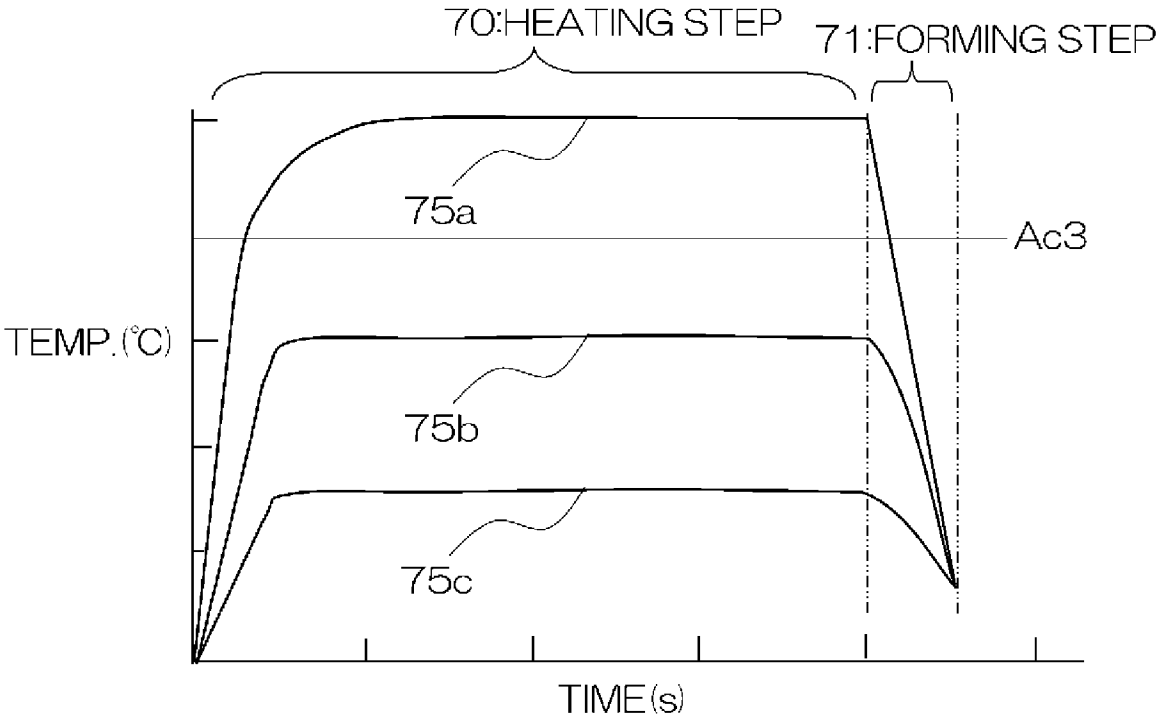

INFRARED HEATING METHOD, INFRARED HEATING AND FORMING METHOD OF STEEL SHEET AND AUTOMOBILE COMPONENT OBTAINED THEREBY, AND INFRARED HEATING FURNACE

CROSS-REFERENCE TO RELATED APPLICATIONS

The present application claims priority based on JP Patent Application 2013-018877 filed on Feb. 1, 2013, whose entire disclosure is incorporated herein by reference thereto.

This invention relates to an infrared heating method and automobile components obtained thereby, and an infrared heating furnace.

TECHNICAL FIELD

Background

With increasing needs for reducing automobile body weight to improve fuel consumption and needs for corrosion safety, a die-quenching method is attracting attention as a method of manufacturing automobile body components. In the die-quenching method, a heated steel sheet is rapidly cooled simultaneously with being formed in forming dies, consequently being quench-hardened.

In Addition, regarding the automobile body components, it is desired to provide a strength variation or distribution in one component in order to save labor of welding high and low strength components each other for making one component. Such component has merits of ensuring enough strength due to a high strength portion and of easy processing due to a low strength portion.

Furthermore, an infrared method is attracting attention as a heating method for quench-hardening a steel sheet. In the infrared method, infrared rays are irradiated onto a work to heat the work by absorbing the infrared rays.

Patent Literatures related to the background described above are listed below.

Patent Literature 1 proposes to dispose a plate (shield) having a predetermined shape between a steel sheet and infrared lamps, and to set a different heating distribution in at least a portion of one side (of surface) where the steel sheet is not-covered with the plate from that of the other side (of surface) where the steel sheet is covered with the plate.

Patent Literature 2 proposes to partially change a target cooling temperature of a steel sheet for partially quench-hardening the steel sheet.

Patent Literature 3 proposes a partially quench-hardening method of a steel sheet, in which a cooling conduit is disposed in press-forming dies.

Patent Literature 4 proposes an infrared heating apparatus having infrared lamps arranged matrixwise, in which outputs of the infrared lamps arranged on a predetermined column(s) are lowered, and outputs of the infrared lamps arranged on the other column(s) is increasing, in order to set different heating conditions per each region of the steel sheet. FIG. 9 is a schematic graph showing heating temperature transitions of a steel sheet according to the infrared heating apparatus of Patent Literature 4.

In a heating step 70 and a following forming step 71 of FIG. 9, a first heating temperature transition curve 75*a* indicates a heating temperature transition of a high temperature (1000 degrees Celsius) setting region of the steel sheet, a second heating temperature transition curve 75*b* indicates a heating temperature transition of a first low temperature (600 degrees Celsius) setting region of the steel sheet, and a third heating temperature transition curve 75*c* indicates a heating temperature transition of a second low temperature (300 degrees Celsius) setting region of the steel sheet.

Referring to the second and third heating temperature curves in FIG. 9, after the temperatures of the second and third low temperature setting regions have reached target temperatures (600 degrees Celsius and 300 degrees Celsius), respectively, heating of the second and third low temperature setting regions is stopped so as not to heat further exceeding those target temperatures, i.e., the steel sheet has not been uniformly heated.

Patent Literature 5 proposes a method in which partial heating of the steel sheet is performed by electric heating or high frequency induction heating, followed by die-quenching the steel sheet.

PATENT LITERATURE (PTL)

[PTL 1]
JP4575976B
[PTL 2]
JP2005-161366A
[PTL 3]
JP2002-241835A
[PTL 4]
JP2011-99567A
[PTL 5]
JP2009-22995A

SUMMARY

The entire disclosure of the above patent literatures is incorporated herein by reference thereto.

The following analysis is given by the present invention. According to Patent Literatures 2 or 3, in press-forming dies, a temperature distribution is formed in the steel sheet, consequently, a structure of the press-forming dies is complicated, additionally, a labor and time is required for setting different conditions depending on variety of kinds of components which require different regions to be quench-hardened.

Furthermore, referring to FIG. 9, the low temperature setting regions are not heated up to their target temperatures according to Patent Literatures 4, therefore, heat amount is increased from the high temperature setting regions to the low temperature setting regions, so that a temperature of the high temperature setting regions degreases, thus generating a possibility of failure in obtaining a desirable strength distribution. Still more, when the low temperature setting regions are lower, a large spring-back is generated after the forming, thus resulting in a lowered shape fixability.

It is desired to provide an infrared heating method of a steel sheet that can contribute to manufacture a steel sheet with a desirable characteristic distribution, and that can contribute to save labor in a steel sheet forming and to simplify steel sheet forming facilities.

In a first aspect, there is provided the following means (an infrared heating method), the method comprising:

wholly infrared heating a steel sheet uniformly up to a temperature which is A3 point or above; and temperature distribution controlling, wherein, after the wholly infrared heating, partial lowering of a light intensity of infrared rays irradiated toward the steel sheet is performed to provide a first region having a temperature of A3 point or above and a second region having a temperature less than A1 point in the steel sheet.

In a second aspect, there is provided the following means (an infrared heating and forming method of a steel sheet), the method comprising:

wholly infrared heating a steel sheet up uniformly to a temperature which is A3 point or above;

temperature distribution controlling, wherein, after the wholly infrared heating, partial lowering of a light intensity of infrared rays irradiated toward the steel sheet is performed to provide a first region having a temperature of A3 point or above and a second region having a temperature less than A1 point in the steel sheet; and forming the steel sheet, wherein, after the temperature distribution controlling, the first region is subjected to rapidly cooling and forming to be quench-hardened at or above a critical cooling rate, while the second region is subjected to cooling and forming at a cooling rate below the critical cooling rate.

In a third aspect, there is provided the following means (an automobile component(s)), the component(s) being press-formed according to the heating and forming method of the second aspect based on the first aspect, wherein the first and second regions are different in strength.

In a forth aspect, there is provided the following means (an infrared heating furnace), the furnace comprising:

a plurality of infrared lamps with adjustable outputs disposed directed to one surface of a steel sheet;

a reflecting surface disposed directed to an opposite surface of the steel sheet so as to reflect infrared rays; and at least one (one or more) controller setting outputs of the plurality of the infrared lamps depending on a relative positional relation between the plurality of the infrared lamps and the steel sheet, wherein said at least one controller controlling the outputs of the infrared lamps so as to partially lower a light intensity of infrared rays irradiated toward the steel sheet, in a manner that, after the steel sheet is wholly heated uniformly up to a temperature which is A3 point or above, the heated steel sheet comprises a first region having a temperature of A3 point or above and a second region having a temperature less than A1 point in the steel sheet.

Advantageous effects of Invention are mentioned below without limitation.

Each of the aforementioned aspects contributes to manufacture a steel sheet with a desirable characteristic distribution, and to save labor in a steel sheet forming, and to simplify steel sheet processing facilities.

BRIEF DESCRIPTION OF DRAWINGS

FIG. 1 is a schematic flow diagram showing heating and forming steps according to Exemplary Example 1.

FIG. 2 is a schematic view showing a basic structure of an infrared furnace according to Exemplary Example 2.

FIGS. 3(A)-3(C) are schematic operation views showing a wholly heating according to Exemplary Example 2.

FIGS. 4(A)-4(C) are schematic operation views showing a temperature distribution controlling step according to Exemplary Example 2.

FIG. 5 is a schematic graph showing heating temperature transition of a steel sheet in a heating step and a forming step according to Exemplary Example 3.

FIG. 6 is a schematic continuous cooling transformation (CCT) phase diagram of steel.

FIGS. 7(A)-7(C) are schematic views showing a basic structure of an infrared furnace according to Exemplary Example 5 and a characteristic distribution of a heated work thereby.

FIG. 8 is a schematic graph showing experimental results according to Exemplary Example 6.

FIG. 9 is a schematic graph showing heating temperature transitions of a steel sheet according to the infrared heating apparatus of Patent Literature 4.

PREFERRED MODES

According to an exemplary embodiment of the present disclosure, a wholly steel sheet is once uniformly heated up to a temperature which is A3 point or above, thereby ensuring sufficient formability and shape fixability, and suppressing spring-back after a forming step, even when a second region of the steel sheet is controlled to a partially lowered temperature thereafter.

According to such heating that the wholly steel sheet is once uniformly heating up to a temperature which is A3 point or above, particularly, the second region (the low temperature setting region) is once uniformly heating up to a predetermined high temperature, so that a temperature gradient is small and an amount per unit time of heat transferred from the first region (the high temperature setting region to the second region (the low temperature setting region) is lowered. Thus, in the first region, particularly, a temperature of a portion adjacent to the second region is prevented from lowering below the setting temperature, consequently, a transition area, which is inevitably generated between the first and second regions and having an intermediate characteristic, is formed small in width. There may thus be provided a component exhibiting a sharp characteristic distribution to meet a high accuracy demand in strength or hardness distribution.

In addition, according to the exemplary embodiment, before a forming step, a necessary preparing condition for forming different properties in one piece of the steel sheet is provided, for example, a temperature difference is preformed between the first region to be quench-hardened and the second region not to be quench-hardened, so that, in the following forming step, special or additional process for forming such temperature difference can be omitted. Therefore, in the forming step, through rapidly cooling and cooling in a regular manner, the (partially) quench-hardened steel sheet is provided according to a designed fashion. Besides, in forming facilities, special or additional elements for forming such temperature difference can be omitted.

An infrared furnace according to an exemplary embodiment is an infrared heating apparatus that irradiates near infrared rays for heating a steel sheet. According to the infrared heating apparatus, an entire steel sheet is once uniformly heated up to a temperature range which is A3 point or above, thereafter, a part of near infrared irradiation is suppressed or ceased to provide a temperature distribution in the steel sheet. Depending on the temperature distribution setting when the heated steel sheet is taken out in the infrared furnace, the steel sheet is provided with a desirable strength characteristic distribution through a simple forming step. In particular, near infrared heating is suitable to provide a temperature distribution with high-low temperature difference by partially increasing or decreasing an infrared irradiation amount toward the steel sheet due to high energy density thereof, unlike an atmospheric heating furnace using a gas heating furnace.

For providing a temperature difference between the first and second regions, in the temperature distribution controlling step, an output(s) of at least one of infrared lamps directed to the second region may be preferably lowered, compared with that of at least one of infrared lamps directed to the first region. For example, the output(s) of the infrared lamp(s) directed to the second region in the temperature distribution controlling step is lowered to about 20-80 percent or 40-60 percent from that(those) in the wholly heating step. Optionally, the output(s) of the infrared lamp(s) directed to the second region may be off (shut down). Alternatively or additionally, an infrared radiation shielding or partially transmitting member(s) can be inserted between the predetermined infrared lamp(s) and the steel sheet in order to control a temperature distribution of the steel sheet. A start timing of the temperature distribution controlling step can be determined by using a sensor detecting a temperature of the steel sheet or a timer measuring an elapsed time from heat starting.

Preferably, in the wholly infrared heating step and the temperature distribution step, infrared rays are irradiated toward one surface of the steel sheet, and simultaneously, reflected rays generated by reflection of the infrared rays irradiated toward the one surface of the steel sheet are irradiated onto opposite surface of the steel sheet. Thus, an unexpected temperature lowering of the steel sheet is prevented, by heating due to the reflected rays.

Preferably, the infrared lamp(s) irradiate near infrared rays having a high energy density and suitable to heat a relatively small area. Those wavelengths are preferably in a range of 0.8-2 μm. In addition, the near infrared rays have high energy density as described above, therefore, direct heating such as the infrared heating is advantageous in short-time heating or partial heating of the steel sheet, compared with atmospheric heating using a gas furnace etc. Optionally, infrared rays having relatively longer wavelengths may be used.

An infrared lamp(s) having various kinds of shapes may be used, as the infrared lamps, particularly, linear tube type lamp(s) are preferably used, since the linear tube type lamp(s) is inexpensive and easy to install in an infrared furnace. According to the present disclosure, a characteristic variation or distribution can be sufficiently provided in one component, even if using the linear tube type lamp(s).

Output light intensity of the infrared lamp(s) can be controlled by adjusting an amount of input electric power or of current flowing through an infrared emitting cathode (filament).

As the steel sheet suitable to infrared heating or heat-treating according to the present disclosure, a hypoeutectoid steel sheet, a boron steel sheet, a hot-dip galvannealed (GA) steel sheet or a hot-dip galvanized (GI) steel sheet are exemplified. Furthermore, the steel sheet may be any one capable of being partially heated.

Preferably, at least one of infrared lamps is disposed directed to one surface of the steel sheet, and a reflecting surface is disposed directed to the opposite surface of the steel sheet. The reflecting surface preferably has a high infrared light reflectance such as a mirror surface or glossy surface, for example, 60 percent or more, 70 percent or more, 80 percent or more, or 90 percent or more. The reflecting surface may be made of various metallic platings, for example, Au or Ag plating.

The opposite surface of the steel sheet may be locally cooled by at least one of cooling material (medium), thereby causing change in characteristic of the steel sheet in spot.

Preferably, the infrared lamp(s) may be arranged two or three dimensionally depending on a profile of the steel sheet or a desired characteristic distribution thereof.

Preferably, in a forming step after the temperature distribution controlling step, the first region is quench-hardened (quenched) by rapidly cooling, while the second region is cooled but not quench-hardened (not quenched).

Preferably, the first region is heated to a range of from A3 point or above ranging to a temperature of +10% thereof, and the second region is heated to a range of from a temperature of below A1 point ranging to a temperature minus 10% of the A1 point. Next, examples of target temperature ranges of the first and second regions are enumerated. These target temperatures are preferably optimized depending on composition and scale effect of the steel sheet, and temperature lowering while conveying from the infrared furnace to the forming apparatus (for example, these target temperatures are set slightly higher).

(1) Target Temperature Range of First Region or Target Temperature Range in Uniform (Wholly) Heating:Ac3-1000 degrees Celsius, Ac3-980 degrees Celsius, Ac3-950 degrees Celsius, Ac3-925 degrees Celsius, Ac3-900 degrees Celsius;

(2) Final Target Temperature Range of Second Region:500-Ac1 degrees Celsius, 600-780 degrees Celsius, 650-750 degrees Celsius, 700-725 degrees Celsius.

Preferably, one (single) steel sheet is uniformly (entirely) heated up to a uniform temperature which is Ac3 (austenite transformation) point or above, and then the first region of the same steel sheet is heated in a manner that a temperature of the first region is kept at the aforementioned temperature, i.e., at Ac3 (austenite transformation) point or above, while the second region of the steel sheet is heated in a manner that a temperature of the second region decreases to below Ac1 point. It is noted that the Ac3 point denotes a temperature at which the steel sheet is wholly transformed to austenite at Ac3 point, while the Ac1 point denotes a temperature at which austenite is at pro-eutectoid in the steel sheet.

The aforementioned exemplary embodiments can be suitable combined together as long as the advantageous effects of the present disclosure can be achieved.

The present disclosure will be explained in detail with reference to drawings and exemplary examples. Accordingly, the reference signs referring to the figures are given for convenience in assisting and understanding, to elements in the drawings by way of examples to be regarded as illustrative in nature, and not as restrictive.

Exemplary Example 1

FIG. 1 is a schematic flow diagram showing heating and forming steps according to Exemplary Example 1, wherein showing temperature transitions of a steel sheet in those steps.

Referring to FIG. 1, it is required to make one steel sheet W having a first region R1 of a high strength and a second region R2 of a relatively low strength in a defined manner. In heating step 20, first, the steel sheet W is uniformly infrared heated up to a temperature which is A3 point or above, for example 850 degrees Celsius. This step is called a wholly heating step (uniformly heating step) 20*a*. After the wholly heating step 20*a*, light intensity of infrared rays irradiated toward the steel sheet W is partially lowered in order to provided the first region R1 whose temperature is kept to A3 point or above and the second region R2 having a temperature less than A1 point, for example 600 degrees Celsius in the steel sheet W. This step is called a temperature distribution controlling step 20*b*. The steel sheet W formed of the aforementioned temperature distribution is rapidly conveyed to a forming step 21 and then "rapidly cooled or cooling" and press-forming are performed, simultaneously. This process is called a forming step (die-quenching) step. That is, quenched press-forming for the first region R1 and normal forming for the second region R2 are performed simultaneously, for one work W.

In the forming step 21, both the first and second regions R1,R2 are cooled, for example, down to 100 degrees Celsius (a cooling target temperature). It is noted that a first cooling rate V1 of the first region R1 is higher than a second cooling rate V2 of the second region R2, since a cooling-start temperature of the first region R1 is A3 point or above, while that of the second region R2 is less than A1 point. By setting both the temperature distributions differently at the end of the heating step 20; and the aforementioned common temperature (cooling target temperature) at the end of the forming step; in a manner that the first cooling rate V1 is higher than a quenching critical cooling rate (25 degrees Celsius/sec) causing a martensitic transformation, while the second cooling rate V1 is lower than the quenching critical cooling rate, thereby resulting in the one sheet of the steel sheet W having both the high-strength first region R1 quenched and the high-ductility (low-strength) second region R2 not-quenched.

Exemplary Example 2

In Exemplary Example 2, an infrared furnace capable of executing the aforementioned step suitably and a heating method thereby are described. FIG. 2 is a block diagram showing a basic structure of an infrared furnace according to Exemplary Example 2.

<Basic Structure of Infrared Furnace>

Referring to FIG. 2, the basic structure of the infrared furnace 10 according to Exemplary Example 2 is described. The infrared furnace 10 comprises infrared lamps 1 disposed directed to one surface of a steel sheet W, a reflecting surface disposed directed to the opposite surface of the steel sheet W so as to reflect infrared rays, and a controller(s) 4 setting outputs of the infrared lamps 1, individually. The controller (s) 4 controls on/off and output light intensity of the infrared lamps 1. In infrared furnace 10, a light intensity of infrared rays incident on the one surface of the steel sheet W can be varied corresponding to a position on (within) the steel sheet W.

Such partial control of the incident light intensity on the one surface of the steel sheet W can be achieved by partially controlling output light intensities of the infrared lamps 1, or using an infrared radiation shielding member(s) 5, or both thereof. The member(s) 5 is made of ceramics having mesh-like structure, semitransparent, or porous, for example, clouded quartz glass having a desired transmittance. Further, the member(s) 5 can be formed into various kinds of two or three-dimensional shapes corresponding to a desired characteristic distribution of the steel sheet W.

Alternatively, the controllers 4 may be provided by one-to-one for the infrared lamps 1, respectively and the infrared lamps may be controlled individually. Preferably, when the steel sheet W is supported from below by pins, the infrared lamps 1 are preferably arranged above the steel sheet W, whereas when the steel sheet W is suspended from an upper side, the infrared lamps 1 are preferably arranged below the steel sheet W. The controller(s) 4 may be properly applied to a control of the output light intensities of the infrared lamps 1 in the following various kinds of Exemplary Examples.

Functions and effects obtained by disposing the reflecting surface (of a reflecting member) 3 are explained with reference to the following experiment results.

Measurements were performed under two heating conditions as follows:

(1) the infrared lamps 1 are only disposed on the one side of the steel sheet W and the reflecting surface 3 is disposed on the opposite (another) side of the steel sheet W as shown in FIG. 2, i.e., single side heating condition is performed;

(2) the infrared lamps 1 are disposed on the both sides of the steel sheet, i.e., both sides heating condition is performed;

a temperature rising rate of a boron steel sheet having a thickness of 1.6 mm, and a temperature difference between the one side surface and the opposite surface thereof, was measured.

Note that the both sided heating consumes an electrical energy nearly twice as much as the single side heating, since the both sided heating requires twice as the number of the infrared lamps as the single side heating.

In the single side heating, a rising time from room temperature to 900 degrees Celsius is 31.4 second, while in the both sides heating, that rising time is 29.6 second. There were no significant difference between the two rising times. Hence, it has turned out that the single side heating sufficiently shortens the temperature rising time with saving energy. In addition, even if in the single side heating, the temperature difference between the one and opposite surfaces of the Boron steel sheet is suppressed within 5 degrees Celsius. This temperature difference is a level for causing no problem in view of temperature control.

Next, in the infrared furnace 10 of FIG. 2 according to Exemplary Example 2, a heating method of the steel sheet W is described. FIGS. 3(A)-3(C) are schematic operation views showing a wholly heating step according to Exemplary Example 2. FIG. 4(A)-4(C) are schematic operation views showing a temperature distribution controlling step after the wholly heating step.

<Wholly Heating Step>

Referring to FIGS. 3(A)-3(C), in a wholly heating step, both of the infrared lamps 1*a* directed to the first region R1 of the steel sheet W and the infrared lamps 1*b* directed to the second region R2 of the steel sheet W irradiate high light intensity infrared rays 2*a*. Therefore, the high light intensity infrared rays 2*a* impinge on one surface of the steel sheet, and simultaneously, reflected rays 2*c* from the reflecting surface 3 impinge on the opposite surface of the steel sheet W. Thus, as shown in FIG. 3(C), the steel sheet W is uniformly heated.

<Temperature Distribution Controlling Step>

Referring to FIGS. 4(A) and 4(B), in a temperature distribution controlling step following the aforementioned wholly heating step, among the infrared lamps 1, the infrared lamps 1*a* directed to the first region R1 of the steel sheet W continuously irradiate the high light intensity infrared rays 2*a*, while the infrared lamps 1*b* directed to the second region R2 of the steel sheet W irradiate low light intensity infrared rays 2*b*. Therefore, the high light intensity infrared rays 2*a* impinge on the one surface of the first region R1, while the low light intensity infrared rays 2*b* impinge on the one surface of the second region R2, and simultaneously, the reflected rays 2*c* from the reflecting surface 3 impinge on the opposite surface of the steel sheet W.

Referring to FIG. 4(C), by the aforementioned infrared heating, the steel sheet W is formed with the first region R1 having a temperature of A3 point or above and the second region R2 having a temperature less than A1 point. In the following forming step as shown in FIG. 1, particularly, the die-quenching step, the first region R1 is quenched or rapidly cooled (i.e, "quench-hardened") to be enhanced in strength and hardness, while the second region R2 is cooled, but not quenched, so that the second region R2 has low strength and low hardness. A transition area T is generated between the first and second regions R1,R2. The transition area T has an intermediate characteristic between the characteristics of the first and second region R1,R2.

The transition area T is formed small in width for the following reasons:

the infrared lamps 1*b* directed to the second region R2 is lighted on; and the reflected rays 2*c* from the reflecting surface 3 impinge on the opposite surface of the steel sheet W, thus preventing:

a temperature difference between the first and second regions R1,R2 from increasing, so that an amount per unit time of heat flowing from the first region R1 to the second region R2 is lowered; and thus preventing:

in the first region R1, a temperature of a portion adjacent to the second region R2 from lowering below A3 point.

Exemplary Example 3

In Exemplary Example 3, a heating temperature transition of the steel sheet W which is heated in the infrared furnace 10 according to Exemplary Example 2 and is die-quenched as described above in Exemplary Example 1 is explained. FIG. 5 is a schematic graph showing a heating temperature transition of a steel sheet in a heating step and a forming step according to Exemplary Example 3. FIG. 6 is a continuous cooling transformation (CCT) phase diagram of steel.

In FIG. 5, a heating temperature transition of the quench-hardened first region R1 (see FIG. 4(C)) is shown with a first temperature transition line 25*a* (broken line), the not-quench-hardened second region R2 (see FIG. 4(C)) is shown with a second temperature transition line 25*b* (solid line).

Referring to FIGS. 1, 4(A)-4(C), 5 and 6, the steel sheet W is conveyed to the next forming step 21 with keeping the heating state provided in the temperature distribution controlling step 20*b* as follows:

in the temperature distribution controlling step 20*b*, the steel sheet W is heated in a manner that the first region R1 of the steel sheet W is cooled at a cooling rate faster than a critical cooling rate for quench-hardening in the next forming step; and that the second region R2 of the steel sheet W has a temperature less than A1 point, so that the second region R2 can be cooled at a cooling rate slower than the critical cooling rate in the next forming step 21.

Thus, in the forming step 21, the first region R1 is cooled at the cooling rate faster than the critical cooling rate (CCR) relating Martensite Transformation shown in FIG. 6 to provide high strength and high hardness, while the second region R2 is cooled at the cooling rate slower than the critical cooling rate (CCR) to have a mainly bainite or ferrite structure, i.e., to become low-hardness and high-ductility. In this way, the steel sheet is formed with a desirable temperature distribution by setting the temperature when the steel sheet W is conveyed out of the infrared furnace 10.

Exemplary Example 4

In Exemplary Example 4, one setting example of temperature transitions for the first and second regions R1,R2 of the steel sheet W is described in Table 1 as follows:

TABLE 1

| Time (s) | Temperature of First Region R1 (degrees C.) | Temperature of Second Region R2 (degrees C.) |
|---|---|---|
| 0 | — | — |
| 5 | 600 | 600 |
| 8 | 750 | 750 |
| 10 | 800 | 800 |
| 15 | 860 | 860 |
| 30 | 900 | 900 |
| 40 | 900 | 900 |
| 50 | 900 | 850 |
| 60 | 900 | 780 |
| 70 | 900 | 700 |
| 80 | 900 | 600 |
| 90 | 150 | 150 |
| 100 | 100 | 100 |

In Table 1, the heating step is performed between 0-80 seconds, and the forming step (die-quenching step) is performed after 80 seconds. In the heating step, the wholly heating step is performed between 0-40 seconds in which the first and second regions R1,R2 are uniformly heated, and the temperature distribution controlling step is performed between 40-80 second with a temperature of the second region R2 being lowered from 900 to 600 degrees Celsius. Next, both of cooling target temperatures of the first and second regions R1,R2 are 100 degrees Celsius in the forming step.

Exemplary Example 5

In Exemplary Example 5, one example of an infrared furnace which can suitably perform the aforementioned heating step is described. FIGS. 7(A)-7(C) are schematic views showing a basic structure of an infrared furnace according to Exemplary Example 5 and a characteristic distribution of a heated work thereby.

Referring to FIG. 7(A), Exemplary Example 5 is characterized by using a cooling material(s). In the following description of Exemplary Example 5, differences between Exemplary Examples 5 and 2 are mainly described. As for the matter common to the two exemplary examples reference is to be made as necessary to the explanation of Exemplary Example 2.

Referring to FIG. 7(A), an infrared furnace 10 of Exemplary Examples 5 comprises cooling materials 7,7 which locally cool the opposite surface of a steel sheet W. Referring to FIGS. 7(B) and 7(C), in an infrared heating step, portions abutted by the cooling materials 7,7, as well as a left end portion directed to low outputting infrared lamps 1*b*, become second regions R2,R2, whose peripheral portions become transition areas T, and the remaining portions become first region R1.

As the cooling material (or medium), temperature absorbing material(s) made of ceramics or metallic body containing sodium sealed therein can be used to contact on the opposite surface of the steel sheet (work) W. Those temperature absorbing material(s) may be used as a pin(s) for supporting to the steel sheet (work). Further, as the cooling material, water or air can be used to be jetted out of a nozzle disposed directed to the opposite surface of the steel sheet (work) W. Those various cooling media may be used together with the metallic body.

Exemplary Example 6

In the present exemplary example, one example of output controlling method of an infrared lamp depending on set temperature of each region (for example, about 400-900 degrees Celsius) is described with reference to experimental results. Boron steel sheets having a thickness of 1.6 mm, length of 100 mm, and width of 80 mm were used as steel sheets to be infrared heated. A thermocouple was attached to a center portion of each of the boron steel sheets. By changing infrared output light intensities of the infrared lamps between about 50-100%, the boron steel sheets were heated and temperature transitions were measured, respectively.

FIG. 8 is a schematic graph showing experimental results according to Exemplary Example 6. Referring to FIG. 8, it is has found out that, by changing an output light intensity of the infrared lamp(s), a temperature of a steel sheet can be freely set, or by partially controlling infrared output intensity of the infrared lamp(s), temperatures of predetermined regions of a steel sheet are freely set.

The aforementioned Exemplary Embodiments and examples can be used together, insofar as there is no particular remark otherwise stated.

This invention is not limited to the embodiments (examples) described above. It should be noted that other objects, features and aspects of the present invention will become apparent in the entire disclosure and that modifications may be done without departing the gist and scope of the present invention as disclosed herein and claimed as appended herewith.

The disclosures of the above indicated Patent Literatures are to be incorporated herein by reference. The particular exemplary embodiments or examples may be modified or adjusted within the gamut of the entire disclosure of the present invention, inclusive of claims, based on the fundamental technical concept of the invention. Moreover, a variety of combinations or selection of elements herein disclosed, inclusive of various elements of the disclosure, exemplary embodiments, Examples or figures, may be made within the concept of the claims. It is to be understood that the present invention is to include a variety of changes or modifications that may occur to those skilled in the art in accordance with the entire disclosures inclusive of the claims and the technical concept of the invention. Inter alia, if the ranges of numerical values are indicated herein, they should be construed as indicating any arbitrary numerical values or sub-ranges comprised within such ranges even if such effect is not stated explicitly.

It should be noted that symbols for having reference to the drawings, as used in the present Application, are exclusively for assisting in understanding and are not intended to restrict the invention to the mode(s) illustrated.

INDUSTRIAL APPLICABILITY

The present disclosure can be applied for a heating or hot forming method of various kinds of components or parts in general, particularly automobile components or body components, for example, a pillar, a side member, and an impact bar included in door components.

REFERENCE SIGNS LIST

1 Infrared lamp(s)
1*a* Infrared lamp(s) directed to first region
1*b* Infrared lamp(s) directed to second region
2*a* Infrared rays irradiated by infrared lamp(s) directed to first region, High light intensity infrared rays
2*a* Infrared rays irradiated by infrared lamp(s) directed to second region, Low light intensity infrared rays
2*c* Reflected rays
3 Reflecting surface (Reflective surface)
4 Controller(s)
5 Member (Article)
7 Cooling material (or Medium)
10 Infrared furnace, Infrared apparatus
W Steel sheet, Work
R1 First region, Quenched (High strength) region, Quench-hardened region
R2 Second region, Not-quenched (Low strength) region, Low hardness region
T Transition area, Gradually changing area of characteristic
20 Heating step
20*a* Wholly heating step, Uniformly heating step
20*b* Temperature distribution controlling step
21 Forming step,
25*a* First temperature transition line of first region
25*b* Second temperature transition line of second region

The invention claimed is:

1. An infrared heating method, comprising:

wholly infrared heating a steel sheet uniformly up to a temperature which is A3 point or above; and temperature distribution controlling, wherein, after the wholly infrared heating, partial lowering of a light intensity of infrared rays irradiated toward the steel sheet is performed to provide a first region having a temperature of A3 point or above and a second region having a temperature less than A1 point in the steel sheet, wherein in the wholly infrared heating and the temperature distribution controlling, one surface of the steel sheet is irradiated directly by the infrared rays without being irradiated by reflected rays generated by reflection of the infrared rays, and simultaneously, an opposite surface of the steel sheet is irradiated by the reflected rays without being irradiated directly by the infrared rays.

2. The infrared heating method according to claim 1, wherein in the temperature distribution controlling, lowering of an output(s) of at least one of infrared lamps directed to the second region is performed, compared with that of at least one of infrared lamps directed to the first region.

3. The infrared heating method according to claim 2, wherein the infrared lamps are capable of directly heating the steel sheet.

4. The infrared heating method according to claim 1, wherein the method is so adapted to a subsequent forming after the temperature distribution controlling, that the first region is quench-hardened by rapidly cooling, while the second region is not quench-hardened.

5. The infrared heating method according to claim 4, wherein in the forming, target cooling temperatures of the first and second region are common.

6. The infrared heating method according to claim 1, wherein in the temperature distribution controlling, the first region is heated to a range of from A3 point ranging to a temperature of +10% thereof, and the second region is heated to a range of from a temperature of below A1 point ranging to a temperature minus 10% of the A1 point.

7. The infrared heating method according to claim 1, wherein the wholly infrared heating and the temperature distribution controlling are continuously performed, without moving the steel sheet.

8. An infrared heating and forming method of a steel sheet, comprising:

wholly infrared heating a steel sheet uniformly up to a temperature which is A3 point or above;

temperature distribution controlling, wherein, after the wholly infrared heating, partial lowering of a light intensity of infrared rays irradiated toward the steel sheet is performed to provide a first region having a temperature of A3 point or above and a second region having a temperature less than A1 point in the steel sheet; and processing the steel sheet, wherein, after the temperature distribution controlling, the first region is subjected to rapidly cooling and forming to be quench-hardened at or above a critical cooling rate, while the second region is subjected to cooling and forming at a cooling rate below the critical cooling rate, wherein in the wholly infrared heating and the temperature distribution controlling, one surface of the steel sheet is irradiated directly by the infrared rays without being irradiated by reflected rays generated by reflection of the infrared rays, and simultaneously, an opposite surface of the steel sheet is irradiated by the reflected rays without being irradiated directly by the infrared rays.

9. The infrared heating and forming method according to claim 8, wherein the wholly infrared heating and the temperature distribution controlling are continuously performed, without moving the steel sheet.

10. The infrared heating and forming method according to claim 8, wherein the steel sheet is heated by direct incident of infrared rays.

* * * * *